US008796919B2

(12) United States Patent
Matsubayashi et al.

(10) Patent No.: US 8,796,919 B2
(45) Date of Patent: Aug. 5, 2014

(54) LIGHT EMITTING SHEET HAVING HIGH DIELECTRIC STRENGTH PROPERTIES AND CAPABLE OF SUPPRESSING FAILURES

(75) Inventors: Yumiko Matsubayashi, Tokyo (JP); Satoshi Naganawa, Tokyo (JP); Yoshitomo Ono, Tokyo (JP)

(73) Assignee: Lintec Corporation, Tokyo (JP)

( * ) Notice: Subject to any disclaimer, the term of this patent is extended or adjusted under 35 U.S.C. 154(b) by 177 days.

(21) Appl. No.: 13/391,131

(22) PCT Filed: Jul. 8, 2010

(86) PCT No.: PCT/JP2010/061625

§ 371 (c)(1),
(2), (4) Date: Feb. 17, 2012

(87) PCT Pub. No.: WO2011/021448

PCT Pub. Date: Feb. 24, 2011

(65) Prior Publication Data

US 2012/0146490 A1 Jun. 14, 2012

(30) Foreign Application Priority Data

Aug. 19, 2009 (JP) ..... 2009-190358

(51) Int. Cl.
*H05B 33/14* (2006.01)
*H05B 33/22* (2006.01)

(52) U.S. Cl.
USPC ..... 313/509; 313/498; 313/506; 313/503; 445/58

(58) Field of Classification Search
USPC ..... 313/503, 509, 498; 445/24, 58
See application file for complete search history.

(56) References Cited

U.S. PATENT DOCUMENTS 5,432,015 A 7/1995 Wu et al.
5,585,695 A * 12/1996 Kitai ..... 313/506
5,634,835 A 6/1997 Wu et al.
5,679,472 A 10/1997 Wu et al.

(Continued)

FOREIGN PATENT DOCUMENTS

CN 101128941 A 2/2008
EP 1 182 909 A2 2/2002

(Continued)

OTHER PUBLICATIONS

U.S. Appl. No. 13/523,591, filed Jun. 14, 2012, Naganawa, et al.

(Continued)

*Primary Examiner* — Sikha Roy
(74) *Attorney, Agent, or Firm* — Oblon, Spivak, McClelland, Maier & Neustadt, L.L.P.

(57) ABSTRACT

A light-emitting sheet including: a first electrode; a second electrode; and a light-emitting layer disposed between the first and the second electrodes, where the first electrode and/or the second electrode disposed on and under the periphery of the light-emitting layer arc cut to form a non-conductive portion being electrically disconnected with a circuit that applys a voltage to the light-emitting sheet, and as seen from a vertical direction to the plane of the light-emitting sheet, the non-conductive portion formed from the first electrode or the non-conductive portion formed from the second electrode surrounds the light-emitting layer, or the non-conductive portion formed from the first electrode and the non-conductive portion formed from the second electrode are apparently connected to each other and surrounds the light-emitting layer.

20 Claims, 6 Drawing Sheets

LIGHT-EMITTING SHEET 2
(LATERAL SECTION)

(56) References Cited

U.S. PATENT DOCUMENTS

| | | | | |
|---|---|---|---|---|
| 5,691,738 | A | 11/1997 | Arai et al. | |
| 5,702,565 | A | 12/1997 | Wu et al. | |
| 5,756,147 | A | 5/1998 | Wu et al. | |
| 7,071,618 | B2 * | 7/2006 | Ishikawa et al. | 313/509 |
| 2002/0021084 | A1 * | 2/2002 | Yoneda | 313/498 |
| 2004/0219710 | A1 | 11/2004 | Dubbeldam | |
| 2006/0157103 | A1 * | 7/2006 | Sheats et al. | 136/244 |

FOREIGN PATENT DOCUMENTS

| | | | |
|---|---|---|---|
| JP | 3 19296 | | 2/1991 |
| JP | 04-190586 | | 7/1992 |
| JP | 07 235380 | | 9/1995 |
| JP | 2000208278 | A * | 7/2000 |
| JP | 2003 045647 | | 2/2003 |
| JP | 2004-234942 | | 8/2004 |
| JP | 2004 235167 | | 8/2004 |
| JP | 2008 041381 | | 2/2008 |
| JP | 2008 123700 | | 5/2008 |
| JP | 2001-313168 | A | 11/2009 |
| WO | WO 2006/078985 | A2 | 7/2006 |

OTHER PUBLICATIONS

International Search Report Issued Aug. 10, 2010 in PCT/JP10/061625 Filed Jul. 8, 2010.

U.S. Appl. No. 13/390,715, filed Feb. 16, 2012, Matsubayashi, et al.

Combined Chinese Office Action and Search Report issued Feb. 7, 2014, in Chinese Patent Application No. 201080036657.3 with English translation of category of cited documents.

Extended European Search Report issued Feb. 3, 2014, in European Patent Application No. 10809793.2.

* cited by examiner

LIGHT-EMITTING SHEET 1
(SECOND ELECTRODE SURFACE SIDE)

LIGHT-EMITTING SHEET 1
(LATERAL SECTION)

LIGHT-EMITTING SHEET 2
(SECOND ELECTRODE SURFACE SIDE)

LIGHT-EMITTING SHEET 2
(FIRST ELECTRODE SURFACE SIDE)

LIGHT-EMITTING SHEET 2
(LATERAL SECTION)

LIGHT-EMITTING SHEET 2
(VERTICAL SECTION)

LIGHT-EMITTING

LIGHT-EMITTING SHEET 3
(VERTICAL SECTION)

LIGHT-EMITTING SHEET 3
(LATERAL SECTION)

LIGHT EMITTING SHEET HAVING HIGH DIELECTRIC STRENGTH PROPERTIES AND CAPABLE OF SUPPRESSING FAILURES

TECHNICAL FIELD

The present invention relates to a light-emitting sheet. In more detail, the present invention relates to a light-emitting sheet which does not cause failures such as a short circuit and which is able to realize stable driving.

BACKGROUND ART

As functional elements in the electric/electronic field or the optical field, there is known an electroluminescent element capable of emitting light by applying a voltage. In general, this electroluminescent element can be broadly classified into an inorganic electroluminescent element having a light-emitting layer which contains an inorganic electroluminescent material (hereinafter referred to as "inorganic EL element") and an organic electroluminescent element having a light-emitting layer which contains an organic electroluminescent material (hereinafter referred to as "organic EL element").

In comparison with the organic EL device, the inorganic EL device is hard to emit light with high luminance, it has such an advantage that not only it is excellent in long-term stability, but it stably causes light emission even under a severe condition such as a high temperature. For that reason, in order to utilize it in fields where weather resistance, heat resistance, long-term stability, or the like is required, studies regarding the inorganic EL element are being continued.

An inorganic EL element which is driven by an alternating current source can be formed on paper or a polymer film by utilizing a printing technology, and it forms a market as an illumination device in which flexibility is required. As such an inorganic EL element, there is known an electroluminescent element in which an insulating layer and a light-emitting layer are formed on a back-side electrode, a transparent electrode is provided thereon, and the top and bottom thereof are covered with a hygroscopic film. The light-emitting layer is printed by means of screen printing or the like (see, for example, Patent Document 1). However, such a technique requires a lot of manufacturing processes. For that reason, as a method capable of achieving mass production, there is known a method of inexpensively manufacturing an inorganic EL element by means of roll printing and lamination (see, for example, Patent Document 2).

PRIOR ART DOCUMENTS

Patent Documents

Patent Document 1: JP-B-7-58636
Patent Document 2: JP-A-2004-234942

SUMMARY OF THE INVENTION

Problem to be Solved by the Invention

In inorganic EL elements manufactured by the conventional methods, because the upper and lower are come to close one another at the end of element, dielectric breakdown possibly occurs by applying a voltage, so failures such as a short circuit are frequently caused.

To solve the above problem, the present invention provides a light-emitting sheet having high dielectric strength properties and capable of suppressing failures such as a short circuit.

Means for Solving the Problem

That is, the present invention relates to the following [1] to [4].

[1] A light-emitting sheet comprising a first electrode, a second electrode, and a light-emitting layer disposed between the first and the second electrodes, wherein the first electrode and/or the second electrode disposed on and under the periphery of the light-emitting layer are cut to form a non-conductive portion being electrically disconnected with a circuit for applying a voltage to the light-emitting sheet, and as seen from a vertical direction to the plane of the light-emitting sheet, the non-conductive portion formed from the first electrode or the non-conductive portion formed from the second electrode surrounds the light-emitting layer, or the non-conductive portion formed from the first electrode and the non-conductive portion formed from the second electrode are apparently connected to each other and surrounds the light-emitting layer.

[2] The light-emitting sheet according to [1], wherein the first electrode and/or the second electrode are cut with a laser.

[3] The light-emitting sheet according to [1] or [2], wherein a minimum value of a creepage distance between a conductive portion of the first electrode and a conductive portion of the second electrode being electrically connected to each other is 2 mm or more by cutting the electrode or electrodes.

[4] The light-emitting sheet according to any one of [1] to [3], comprising a dielectric layer between the first electrode or the second electrode and the light-emitting layer.

Effect of the Invention

According to the present invention, is possible to provide a light-emitting sheet in which dielectric breakdown will not occur at the ends of the element by applying a voltage, failures such as a short circuit will not be caused, and will be stable to drive.

MODES FOR CARRYING OUT THE INVENTION

Figure 7:
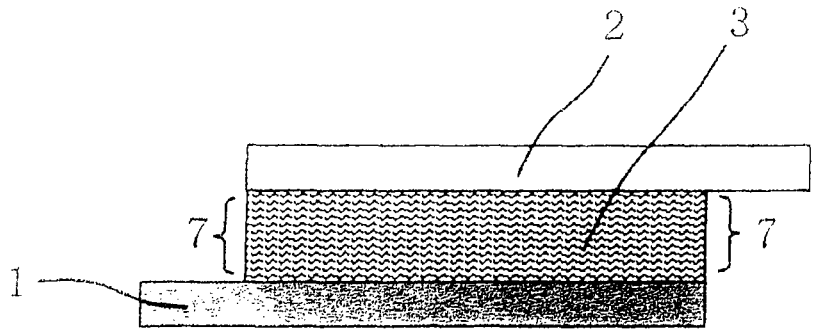
FIG. 7 is a diagram explaining a position of the "periphery" of a light-emitting layer.
Figure 9:
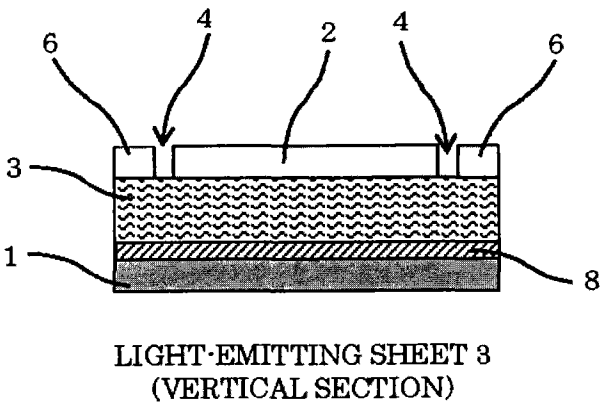
FIG. 9 is vertical sectional view of the light emitting sheet 3.
Figure 8:
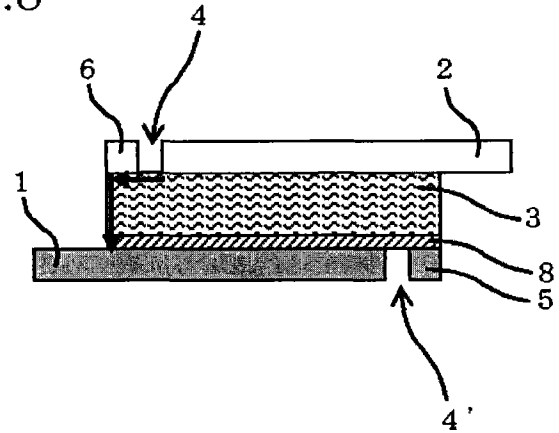
FIG. 8 is a lateral sectional view of the light-emitting sheet 3, which contains a dielectric layer 8 between the first electrode 5 and the light-emitting layer 3.
Figure 11:
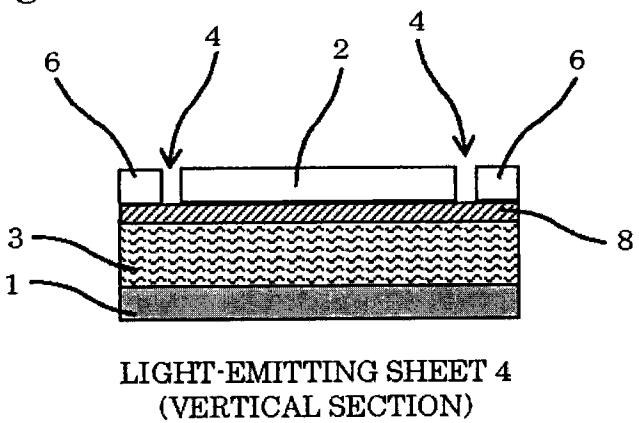
FIG. 11 is vertical sectional view of the light emitting sheet 4.
Figure 10:
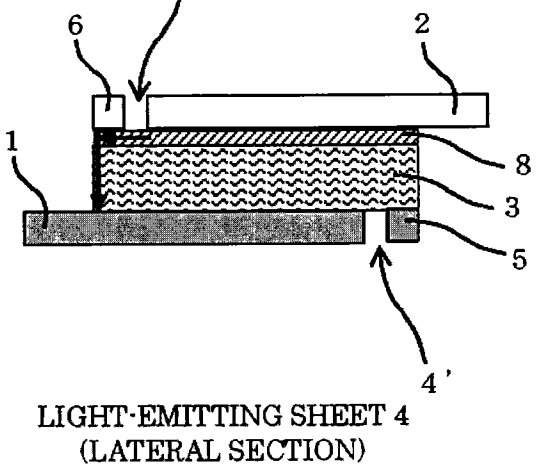
FIG. 10 is a lateral sectional view of the light emitting sheet 4, which contains a dielectric layer 8 between the second electrode 2 and the light-emitting layer 3.

The light-emitting sheet of the invention relates to a light-emitting sheet comprising a first electrode, a second electrode, and a light-emitting layer disposed between the first and the second electrodes, wherein the first electrode and/or the second electrode disposed on and under the periphery of the light-emitting layer (hereinafter referred to as "light-emitting layer periphery") is cut to form a non-conductive portion being electrically disconnected with a circuit for applying a voltage to the light-emitting sheet. Here, the term "light-emitting layer periphery" is a side surface site of the light-emitting layer which does not face any of the first electrode and the second electrode, and in FIG. 7 showing a lateral sectional view of a light-emitting sheet, the light-emitting layer periphery means a side surface site 7 of a light-emitting layer 3 disposed between a first electrode substrate 1 and a second electrode substrate 2. A planar shape of the light-emitting sheet is not particularly limited, and it may be any of a quadrilateral-shape such as a square, a rectangle, a trapezoid, a rhombus or the like, a triangle, a circle, an ellipse, and a star. Hereinafter, a light-emitting sheet in which the first electrode is a cathode, the second electrode is an anode, the first substrate side is a back, and the second substrate is a front is explained as an example, but it should not be limited thereto.

(Substrate for Electrode)

It is preferred that the first electrode (cathode) and the second electrode (anode) is formed on an each substrate (hereinafter, a substrate for the first electrode and a substrate for the second electrode are referred to as "first substrate" and "second substrate", respectively; and a laminate of the first electrode on the first substrate and a laminate of the second electrode on the second substrate are referred to as "first electrode substrate" and "second electrode substrate", respectively). The first substrate and the second substrate are not particularly limited, for example, glass plates or plastic films can be used. From the point of view that they have flexibility and are able to reduce the weight, plastic films are preferred. As the plastic films, films which may not permeate moisture or whose moisture permeability is extremely low are preferred. In addition, it is important that the second substrate has transparency.

As materials such a plastic films, polyesters and polyamides are preferred from the viewpoints of costs and multiplicity of uses. Examples of the polyester include polyethylene terephthalate, polybutylene terephthalate, polyethylene naphthalate, polyarylates. Also, examples of the polyamide include wholly aromatic polyamides, nylon 6, nylon 66, nylon copolymers.

Although a thickness of the substrate to be used is not particularly limited, it is generally from 1 to 1,000 μm, preferably from 5 to 500 μm, and from the viewpoint of practicality, more preferably from 10 to 200 μm.

In addition, it is not particularly needed that the first substrate is transparent.

Although the second substrate may be either colorless transparent or colored transparent, it is preferred that the second substrate is colorless transparent from the viewpoint of not scattering or attenuating light emitted from a light-emitting layer as described below.

Also, in each of the first substrate and the second substrate, a moisture barrier layer (gas barrier layer) can be provided on its front or back surface as necessary. As a material of the moisture barrier layer (gas barrier layer), inorganic materials such as silicon nitride and silicon oxide are suitably used. The moisture barrier layer (gas barrier layer) can be, for example, formed by a high-frequency sputtering method or the like.

[First Electrode; Cathode]

The first electrode (cathode) in the light-emitting sheet of the present invention is not particularly limited as far as it has a function as a cathode, and it can be appropriately selected from known cathodes according to an application of the light-emitting sheet.

Examples of a material of the first electrode include metals, alloys, metal oxides, organic conductive compounds, and mixtures thereof.

Specific examples of the material of the first electrode include gold, silver, lead, aluminum, indium, ytterbium, and alloys or mixture of such a metal and an alkali metal or an alkaline earth metal; organic conductive polymers such as polyaniline, polythiophene, and polypyrrole. These materials may be used alone or as a combination of two or more thereof. Among these materials, it is preferred that its work function is not more than 4.5 eV.

Among these materials, a material mainly composed of aluminum is preferred in regard to its excellent stability. The material mainly composed of aluminum as referred to herein means aluminum alone, or an alloy or a mixture of aluminum and about 0.01 to 10% by mass of an alkali metal or an alkaline earth metal (for example, a lithium-aluminum alloy, a magnesium-aluminum alloy, and the like).

Since the formation method of the first electrode is not particularly limited, it is possible to form the first electrode by a known method. For example, in view of the properties of a material, the first electrode can be formed on the first substrate by a method appropriately selected from among a wet process such as a printing method and a coating method, a physical process such as a vacuum vapor deposition method, a sputtering method, an ion plating method, a chemical process such as a CVD method (chemical vapor deposition method) and a plasma CVD method, and a method of laminating metal foils.

For example, in the case of selecting metals such as aluminum as the material of the first electrode, the first electrode can be formed by a method such as sputtering one or two or more kinds of metal on the substrate simultaneously or successively, or laminating metal foils.

Although a thickness of the first electrode can be appropriately selected depending on the material and not be generalized, it is generally in the range of 10 nm to 50 μm, preferably 20 nm to 20 μm, and more preferably 50 nm to 15 μm. It is noted that this first electrode may be transparent or be opaque. A surface resistivity of the first electrode is preferably not more than $10^3\Omega/\square$, and more preferably not more than $10^2\Omega/\square$. The surface resistivity is a value determined by a method described in the Examples.

[Second Electrode; Anode]

The second electrode (anode) in the light-emitting sheet of the present invention is not particularly limited as far as it has a function as an anode and transparency, and it can be appropriately selected from known anodes according to an application of the light-emitting sheet.

Examples of the material of the second electrode include metals, alloys, metal oxides, organic conductive compounds, and mixtures thereof.

Specific examples of the material of the second electrode include metal oxides such as tin oxide, antimony-doped tin oxide (ATO), fluorine-doped tin oxide zinc oxide, indium oxide, indium tin oxide (ITO), and indium zinc oxide (IZO); metals such as gold, silver, chromium, and nickel; mixture or laminate of these metal oxides and metals; organic conductive polymers such as polyaniline, polythiophene, and polypyrrole. Among these materials, it is preferred that its work function is 4.0 eV or more, and from the viewpoint of its high transparency, ITO is particularly preferred.

The second electrode can be formed by a known method. For example, in view of the properties of material, the second electrode can be formed on the second substrate by a method appropriately selected from a wet process such as a printing method and a coating method, a physical process such as a vacuum vapor deposition method, a sputtering method, and an ion plating method, a chemical process such as CVD and a plasma CVD method.

For example, in the case of selecting ITO as the material of the second electrode, the second electrode can be formed by a method such as direct current or high-frequency sputtering method, a vacuum vapor deposition method, and an ion plating method. Also, in the case of selecting an organic conductive compound as the material of the second electrode, the second electrode can be formed by a wet film forming method.

Although a thickness of the second electrode can be appropriately selected depending on the material and not be generalized, it is normally in the range of 10 to 1,000 nm, preferably 20 to 500 nm, and more preferably 50 to 200 nm.

A surface resistivity of the second electrode is preferably not more than $10^2\Omega/\square$, and more preferably not more than $10^2\Omega/\square$. The surface resistivity is a value determined by a method described in the Examples.

Though the second electrode may be colorless transparent or colored transparent, it is preferably colorless transparent. In addition, in order to allow the escape produced light from the second electrode side, a transmittance of the laminate of the second substrate and the second electrode is preferably 60% or more, and more preferably 70% or more. The transmittance is a value determined by a method described in the Examples.

[Light Emitting Layer]

In the light-emitting sheet of the present invention, the light-emitting layer can be, for example, formed by coating a light-emitting composition on the first electrode or the second electrode, or a dielectric layer as described below. Also, the light-emitting layer may be formed by coating a light-emitting composition on a release film and then transferring it onto the first electrode or the second electrode, or the dielectric layer.

It is possible to use the light-emitting composition which contains an electroluminescent material and a matrix resin. The electroluminescent material and the matrix resin will be sequentially described below.

(Electroluminescent Material)

As the electroluminescent material, any of an inorganic electroluminescent material and an organic electroluminescent material can be used. From the viewpoint of an application of the light-emitting sheet of the present invention, it is preferred to use an inorganic electroluminescent material which is excellent in long-term stability.

Inorganic Electroluminescent Material

Examples of the inorganic electroluminescent material include those in which a base material of zinc sulfide (ZnS) is doped with copper, manganese, terbium fluoride, samarium fluoride or thulium fluoride as a main luminescent material, i.e. ZnS:Cu, ZnS:Mn, ZnS:TbF3, ZnS:SmF3 and ZnS:TmF3; a base material of calcium sulfide (CaS) is doped with europium as a main luminescent material, i.e. CaS:Eu; a base material of strontium sulfide (SrS) is doped with cerium as a main luminescent material, i.e. SrS:Ce; and a base material of alkaline earth-based calcium sulfide such as $CaCa_2S_4$ and $SrCa_2S_4$ is doped with a transition metal such as manganese or a rare earth element such as europium, cerium, and terbium as a main luminescent material.

Among these materials, ZnS:Cu emits green light; ZnS:Mn emits yellowish orange light; $ZnS:TbF_3$ emits green light; $ZnS:SmF_3$ and CaS:Eu emit red light; and $ZnS:TmF_3$ and SrS:Ce emit blue light.

Furthermore, Examples of the inorganic electroluminescent material include oxide light-emitting materials composed of $Sc_2O_3$ doped with a rare earth element such as Y, La, Ce, Pr, Nd, Sm, Eu, Gd, Tb, Dy, Ho, Er, Tm, Yb, and Lu, exclusive of Sc. The rare earth element used for doping is preferably Ce, Sm, Eu, Tb, or Tm. Depending on the kind of the rare earth element, the inorganic electroluminescent material emits yellow light, red light which has a longer wavelength than yellow light, or green or blue light which has a shorter wavelength than yellow light.

In the present invention, these inorganic electroluminescent materials may be used alone, or a combination of two or more thereof, if desired.

Organic Electroluminescent Material

As the organic electroluminescent material, any of low-molecular weight material and high-molecular weight material can be used. Also, any of fluorescent materials and phosphorescent materials can be used.

Examples of the low-molecular weight organic electroluminescent material include benzoxazole derivatives, benzoimidazole derivatives, benzothiazole derivatives, styrylbenzene derivatives, polyphenyl derivatives, diphenylbutadiene derivatives, tetraphenylbutadiene derivatives, naphthalimide derivatives, coumarin derivatives, perylene derivatives, perinone derivatives, oxadiazole derivatives, aldazine derivatives, pyraridine derivatives, cyclopentadiene derivatives, bisstyrylanthracene derivatives, quinacridone derivatives, pyrrolopyridine derivatives, thiadiazolopyridine derivatives, styrylamine derivatives, aromatic dimethylidene compounds, aromatic diamine derivatives, ortho-metalated complexes such as various metal complexes typified by metal complexes and rare earth complexes of 8-quinolinol derivatives [a generic name of a group of compounds described in, for example, YAMAMOTO Akio, Organometallic chemistry—principles and applications, pages 150 and 232, Shokabo Publishing Co., Ltd. (1982); H. Yersin, Photochemistry and Photophysics of Coordination Compounds, pages 71 to 77 and 135 to 146, Springer-Verlag (1987)], and porphyrin metal complexes.

In addition, Examples of the high-molecular weight organic electroluminescent material include polythiophene derivatives, polyphenylene derivatives, polyphenylene vinylene derivatives, and polyfluorene derivatives, which are fluorescent materials.

In the present invention, as the organic electroluminescent materials, one of the low-molecular weight materials and high-molecular weight materials may be used, or two or more thereof may be used in combination.

In the case where the light-emitting layer is made of an organic electroluminescent material, it is preferred to form a hole injection/transport layer on the anode side of the light-emitting layer and an electron injection/transport layer on the cathode side thereof, respectively.

While a content of the electroluminescent material in the light-emitting layer varies according to the inorganic material or the organic material, in the case of the inorganic material, from the viewpoints of balance between light emission properties and economy and the like, in general, the content is preferably in the range of 20 to 900 parts by mass, more preferably 30 to 700 parts by mass, and still more preferably 40 to 500 parts by mass based on 100 parts by mass of a matrix resin as described below.

(Matrix Resin)

Examples of the matrix resin contained in the light-emitting composition include polyesters such as polyethylene terephthalate, polybutylene terephthalate, and polyester-based thermoplastic elastomers; polyurethane and polyurethane-based thermoplastic elastomers; polystyrene and polystyrene-based thermoplastic elastomers; polyvinyl chloride; polyolefins such as polypropylene, and polyolefin-based thermoplastic elastomers; silicone based resins; acrylic resins; and acrylic urethane resins. Among these materials, those having tackiness at ambient temperature are preferred. Using a resin having tackiness at ambient temperature, it is possible to bond the light-emitting layer to the electrode or the dielectric layer on application of pressure. As the resin having tackiness, acrylic resins are preferred.

Examples of acrylic resins include copolymers of a (meth) acrylic ester having from 1 to 20 carbon atoms in alkyl group and a monomer optionally having a functional group such as a carboxyl group and other monomer, namely (meth)acrylic ester copolymers.

Here, examples of the (meth)acrylic ester having from to 20 carbon atoms in alkyl group include methyl (meth)acrylate, ethyl (meth)acrylate, propyl (meth)acrylate, butyl (meth)acrylate, pentyl (meth)acrylate, hexyl (meth)acrylate, cyclohexyl (meth)acrylate, 2-ethylhexyl (meth)acrylate, isooctyl (meth)acrylate, decyl (meth)acrylate, dodecyl (meth)acrylate, myristyl (meth)acrylate, palmityl (meth) acrylate, stearyl (meth)acrylate. These materials may be used alone, or two or more may be used in combination.

A weight average molecular weight of the (meth)acrylic ester copolymer is preferably 300,000 or more, and more preferably 400,000 to 1,000,000.

To the light-emitting composition, additive such as a crosslinking agent, an antioxidant, an ultraviolet absorbing agent, an infrared absorbing agent, a pigment, and a fluorescent material may be optionally added.

A coating method of the light-emitting composition is not particularly limited, and a conventionally known method such as knife coating, roll coating, bar coating, blade coating, die coating, and gravure coating may be applied.

A thickness of the light-emitting layer obtained in this way is generally 0.1 to 100 μm, preferably 5 to 90 μm, and more preferably 20 to 80 μm, from the viewpoints of a luminance of the light-emitting sheet and laminating properties with respect to other layer.

[Dielectric Layer]

In the light-emitting sheet of the present invention, a dielectric layer can be disposed between the first electrode and the light-emitting layer and/or between the light-emitting layer and the second electrode.

As a material for forming this dielectric layer, materials having a high dielectric constant are preferred. Examples thereof include inorganic materials such as $SiO_2$, $BaTiO_3$, SiON, $Al_2O_3$, $TiO_2$, $Si_3N_4$, SiAlON, $Y_2O_3$, $Sm_2O_3$, $Ta_2O_5$, $BaTa_2O_3$, $PbNb_2O_3$, $Sr(Zr,Ti)O_3$, $SrTiO_3$, $PbTiO_3$, $HfO_3$, and Sb-containing $SnO_2$ (ATO); and organic materials such as polyethylene, polypropylene, polystyrene, epoxy resins, and cyanoacetyl cellulose. These materials may be used alone, or two or more thereof may be used in combination.

In the case where the dielectric layer is present between the light-emitting layer and the second electrode, the dielectric layer is required to be transparent. Therefore, among the above materials, inorganic materials such as $SiO_2$, $Al_2O_3$, $Si_3N_4$, $Y_2O_3$, $Ta_2O_5$, $BaTa_2O_3$, $SrTiO_3$, and $PbTiO_3$ are preferred. In the case where the dielectric layer is present between the first electrode and the light-emitting layer, it is not particularly needed that the dielectric layer is transparent.

The dielectric layer can be, for example, formed by coating a dispersion obtained by uniformly dispersing the material for forming a dielectric layer in a suitable binder according to a conventionally known coating method such as spraying, knife coating, roll coating, bar coating, blade coating, die coating, and gravure coating, or by using an extruder. Although the binder is not particularly limited, for example, the same materials as those in the above matrix resin of the light-emitting composition can be used. It is noted that in the case of the organic material, it is possible to coat the material without using a binder.

In the case of driving the light-emitting sheet of the present invention with an alternating current, when an electrical conductivity of the light-emitting layer is too high so that it is difficult to apply a sufficient voltage to the light-emitting layer, or when dielectric breakdown may be occurred due to an over current, the dielectric layer exhibits an effect for controlling such a matter. From the viewpoint of exhibiting the above effect, in general, a thickness of the dielectric layer is preferably 0.1 to 50 μm, and more preferably 10 to 50 μm.

[Light Emitting Sheet]

Figure 5:
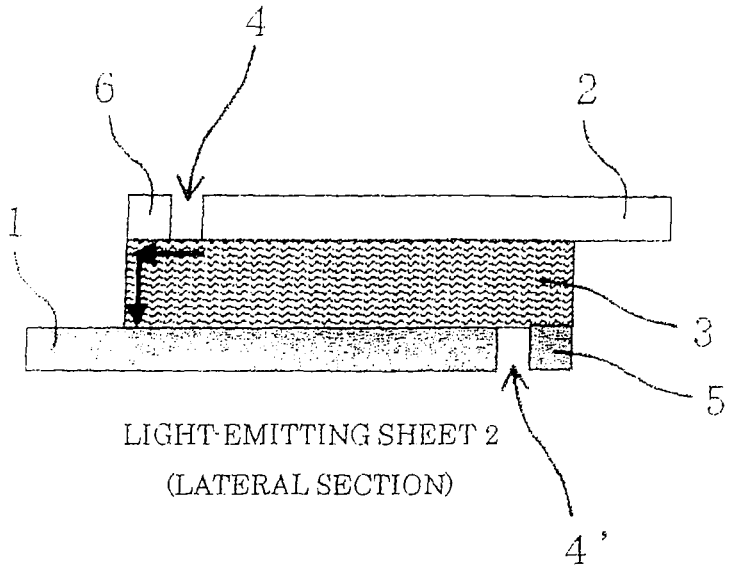
FIG. 5 is a lateral sectional view of the light-emitting sheet 2.

As described above, in the light-emitting sheet of the present invention, the first electrode and/or the second electrode disposed on and under the periphery of the light-emitting layer is cut to form a non-conductive portion being electrically disconnected with a circuit for applying a voltage to the light-emitting sheet (hereinafter referred to simply as "electrically non-conductive state"). As shown in FIG. 5, "the first electrode and/or the second electrode disposed on and under the periphery of the light-emitting layer" as referred to herein means, in the lateral sectional shape of the light-emitting layer, the position which is located around a first electrode edge and/or a second electrode edge disposed on and under a side surface site of the light-emitting layer, namely the position corresponding to a laser cut section 4 or 4' (a cut section will be described below).

In the light-emitting sheet of the present invention, as seen from a vertical direction to the plane of the light-emitting sheet, the non-conductive portion formed from the first electrode or the non-conductive portion formed from the second electrode surrounds the light-emitting layer, or the non-conductive portion formed from the first electrode and the non-conductive portion formed from the second electrode are apparently connected to each other and so surrounds the light-emitting layer.

Figure 2:
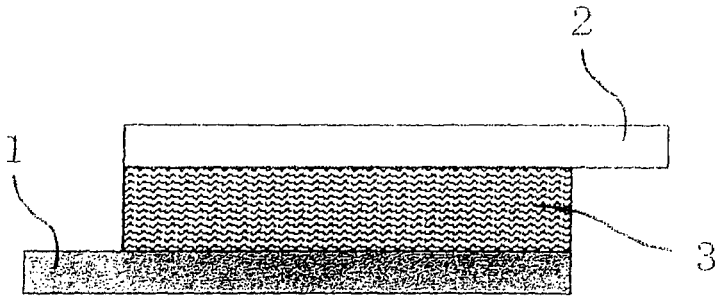
FIG. 2 is a lateral sectional view of the light-emitting sheet 1.

The non-conductive portion may be formed only in the first electrode or the second electrode. In the case of a light-emitting sheet having four sides, the first electrode substrate and the second electrode substrate are projected in order to connect each of the first electrode and the second electrode to a power source as shown in FIG. 2, it is preferred that three sides of one of the electrodes (for example, the second electrode) is cut into a U-shape, and the other electrode (for example, the first electrode) corresponding to the remaining one side is cut to form a non-conductive portion (see FIGS. 3 and 4). By cutting the electrodes as below, a light-emitting sheet comprising a non-conductive portion in which the first electrode and the second electrode each having a substrate are easily connected with a power source is obtained.

(Cutting Condition of Electrode)

Although a method of cutting the electrode is not particularly limited to, it is preferred to use a laser beam machine because of ease-to-use. The laser beam machine is not particularly limited, examples thereof include a YAG laser, a $CO_2$ laser, an excimer laser, and a femtosecond laser.

A laser output or a scanning rate may be appropriately regulated so as to form a non-conductive section. As a standard, for example, in the case of cutting the electrode from the side of electrode substrate, it is generally preferred that a laser output is 30 to 80 W and a scanning rate is 350 to 700 mm/s, and more preferred that a laser output is 30 to 80 W and a scanning rate is 380 to 650 mm/s when the thickness of the electrode substrate is in the range of 50 to 100 μm.

A cut section of the electrode may be located inside the end of the light-emitting layer. However, in order to prevent a light-emitting area being excessively small, the cut section is preferably 2 to 10 mm, more preferably 3 to 8 mm, and still more preferably 4 to 6 mm from the end of the electrode. Also, a part of the light-emitting layer may be cut. It is noted that after cutting the electrode from the electrode side of the electrode substrate, the light-emitting layer and the electrode may be laminated.

From the viewpoint of preventing a short circuit, in general, a cutting line width is preferably 10 μm or more. However, a short circuit preventing ability does not alter even by widening the cutting line width more than necessary, but the light-emitting area becomes small. Therefore, the cutting line width is more preferably 10 to 200 μm, and still more preferably 20 to 180 μm.

In addition, a minimum value of a creepage distance between an edge of the conductive section of the first electrode and an edge of the conductive section of the second electrode, both of which is electrically disconnected, is preferably 2 mm or more, and more preferably 2.5 mm or more by cutting the electrode. The term "creepage distance" as described herein means the shortest distance when a distance between any points of an edge of the conductive section of the first electrode and an edge of the conductive section of the second electrode is measured along the surface of the light-emitting layer (in the case where the light-emitting sheet has a dielectric layer, the surface of the dielectric layer is also included). For example, in FIG. 5, the creepage distance is expressed by a total distance of two arrows. It is noted that the creepage distance is a value not taking into consideration a depth of the light-emitting layer cut together at cutting the electrode.

[Producing Method of Light-Emitting Sheet]

An embodiment of the production of the light-emitting sheet of the present invention is not particularly limited, so any method may be adopted as far as a light-emitting sheet having the above constitution can be obtained.

An example of the method for producing the light-emitting sheet of the present invention include a method in which a first laminate and a second laminate are made by the following process (1) or (2), then the light-emitting layer side of the first laminate and the second electrode side of the second laminate, or the first electrode side of the first laminate and the light-emitting layer side of the second laminate are bonded each other.

(1) A process of forming a first electrode and a light-emitting layer on a first substrate in sequence to make a first laminate, and separately forming a second electrode on a second substrate to make a second laminate.

(2) A process of forming a first electrode on a first substrate to make a first laminate, and separately forming a second electrode and a light-emitting layer on a second substrate in sequence to make a second laminate.

In the above processes (1) and (2), the electrode may be cut at any time, and timing of cut is not particularly limited. Examples thereof include a method in which before forming the light-emitting layer, the electrode is cut in advance to form a non-conductive portion; a method in which after disposing the light-emitting layer between the first electrode and the second electrode, the first electrode and/or the second electrode is cut to form a non-conductive portion; and a method of a combination of these.

Hereinafter, the constitutions of the first laminate and the second laminate are conveniently expressed with symbols as follows. That is, the first substrate and the second substrate are expressed by "1" and 2", respectively. And the first electrode and the second electrode are expressed by "$E^1$" and "$E^2$", respectively. At the same time, the light-emitting layer is expressed by "L", and the dielectric layer as described below is expressed by "D" or "D'".

Then, the method through the above process (1), a laminate having a constitution of 1-$E^1$-L is obtained as the first laminate, and a laminate having a constitution of 2-$E^2$ is obtained as the second laminate. By bonding these first laminate and second laminate with facing L and $E^2$ each other, a light-emitting sheet having a constitution of 1-$E^1$-L-$E^2$-2 is obtained.

In the method through the above process (2), a laminate having a constitution of 1-$E^1$ is obtained as the first laminate, and a laminate having a constitution of 2-$E^2$-L is obtained as the second laminate. By bonding these first laminate and second laminate with facing $E^1$ and L each other, a light-emitting sheet having a constitution of 1-$E^1$-L-$E^2$ is obtained.

Further, making the first laminate and the second layer by anyone of the following processes (3) to (12) and laminating the dielectric layer side, light-emitting layer side or first electrode side of the first laminate and the second electrode side, light-emitting layer side or dielectric layer side of the second laminate by heat lamination, a light-emitting sheet having a dielectric layer between the first electrode or the second electrode and the light-emitting layer can also be obtained. However, the present invention is not particularly limited thereto.

(3) A process of forming a first electrode, a dielectric layer, and a light-emitting layer in this order on a first substrate to make a first laminate, and separately forming a second electrode on a second substrate to make a second laminate.

(4) A process of forming a first electrode and a dielectric layer in sequence on a first substrate to make a first laminate, and separately forming a second electrode and a light-emitting layer in sequence on a second substrate to make a second laminate.

(5) A process of forming a first electrode on a first substrate to make a first laminate, and separately forming a second electrode, a light-emitting layer, and a dielectric layer in this order on a second substrate to make a second laminate.

(6) A process of forming a first electrode, a light-emitting layer, and a dielectric layer in this order on a first substrate to make a first laminate, and separately forming a second electrode on a second substrate to make a second laminate.

(7) A process of forming a first electrode and a light-emitting layer in sequence on a first substrate to make a first laminate, and separately forming a second electrode and a dielectric layer in sequence on a second substrate to make a second laminate.

(8) A process of forming a first electrode on a first substrate to make a first laminate, and separately forming a second electrode, a dielectric layer, and a light-emitting layer in this order on a second substrate to make a second laminate.

(9) A process of forming a first electrode, a dielectric layer, a light-emitting layer, and a dielectric layer in this order on a first substrate to make a first laminate, and separately forming a second electrode on a second substrate to make a second laminate.

(10) A process of forming a first electrode, a dielectric layer, and a light-emitting layer in this order on a first substrate to make a first laminate, and separately forming a second electrode and a dielectric layer in sequence on a second substrate to make a second laminate.

(11) A process of forming a first electrode and a dielectric layer in sequence on a first substrate to make a first laminate, and separately forming a second electrode, a dielectric layer, and a light-emitting layer in this order on a second substrate to make a second laminate.

(12) A process of forming a first electrode on a first substrate to make a first laminate, and separately forming a second electrode, a dielectric layer, a light-emitting layer, and a dielectric layer in this order on a second substrate to make a second laminate.

It is noted that in the above processes (3) to (12), timing of cutting the electrodes is not particularly limited. In addition, in the above processes (9) to (12), the dielectric layer on the first electrode side and the dielectric layer on the second electrode side may be the same as or different from each other.

In the method through each of the above processes (1) to (12), the constitution of the first laminate, the constitution of the second laminate, and the constitution of the obtainable light-emitting sheet are shown in Table 1.

TABLE 1

| Process | Constitution of first laminate | Constitution of second laminate | Constitution of light-emitting sheet |
|---|---|---|---|
| (1) | 1-$E^1$-L | 2-$E^2$ | 1-$E^1$-L-$E^2$-2 |
| (2) | 1-$E^1$ | 2-$E^2$-L | 1-$E^1$-L-$E^2$-2 |
| (3) | 1-$E^1$-D-L | 2-$E^2$ | 1-$E^1$-D-L-$E^2$-2 |
| (4) | 1-$E^1$-D | 2-$E^2$-L | 1-$E^1$-D-L-$E^2$-2 |
| (5) | 1-$E^1$ | 2-$E^2$-L-D | 1-$E^1$-D-L-$E^2$-2 |
| (6) | 1-$E^1$-L-D | 2-$E^2$ | 1-$E^1$-L-D-$E^2$-2 |
| (7) | 1-$E^1$-L | 2-$E^2$-D | 1-$E^1$-L-D-$E^2$-2 |
| (8) | 1-$E^1$ | 2-$E^2$-D-L | 1-$E^1$-L-D-$E^2$-2 |
| (9) | 1-$E^1$-D-L-D' | 2-$E^2$ | 1-$E^1$-D-L-D'-$E^2$-2 |
| (10) | 1-$E^1$-D-L | 2-$E^2$-D' | 1-$E^1$-D-L-D'-$E^2$-2 |
| (11) | 1-$E^1$-D | 2-$E^2$-D'-L | 1-$E^1$-D-L-D'-$E^2$-2 |
| (12) | 1-$E^1$ | 2-$E^2$-D'-L-D | 1-$E^1$-D-L-D'-$E^2$-2 |

From the viewpoint of improving the productivity of the light-emitting sheet of the present invention, the light-emitting sheet may be produced by a roll-to-roll process. The production of the light-emitting sheet of the present invention by the roll-to-roll process is a method in which unwinding a long electrode substrate wound-up into a roll, then formation of a non-conductive section, formation of a light-emitting layer, and bonding to an electrode substrate, and optionally formation of a dielectric layer are performed, followed by wound-up into a roll. Timing of forming the non-conductive section is not particularly limited to, and it is possible to perform at an optional stage.

In the case of adopting the roll-to-roll process, the first electrode and/or the second electrode is cut on both two sides of the light-emitting layer along a flow direction (vertical direction), and the first electrode and/or the second electrode is also cut along width direction (lateral direction).

The method for producing the light-emitting sheet of the present invention by the roll-to-roll process is explained more specifically below, but is not limited thereto.

(Roll-to-Roll Process (I))

(i) The long first electrode substrate (or the second electrode substrate) wound-up into a roll is unwound, and the first electrode (or the second electrode) is cut on two sides along flow direction to form a non-conductive portion. The cut section is preferably 2 to 10 mm, more preferably 3 to 8 mm, and still more preferably 4 to 6 mm from the end of the first electrode (or the second electrode). It is noted that in this case, from the viewpoint of performing the works in the following (ii) and (iii) with ease, it is preferred to cut the electrode so as to remain part of the substrate.

(ii) The light-emitting layer is formed on the first electrode surface of the first electrode substrate (or the second electrode surface of the second electrode substrate).

(iii) The second electrode substrate (or the first electrode substrate) is formed on the light-emitting layer.

(iv) The first electrode and/or the second electrode are cut at any position along width direction of the long light-emitting sheet to form a non-conductive portion. In this case, considering an end of the electrode in the size of the desired light-emitting sheet, the electrode is cut preferably 2 to 10 mm, more preferably 3 to 8 mm, and still more preferably 4 to 6 mm from the end of the electrode.

(v) The obtainable light-emitting sheet is wound-up into a roll.

(Roll-to-Roll System (II))

(i) The long first electrode substrate (or the second electrode substrate) wound-up into a roll is unwound, and the light-emitting layer is formed on the first electrode surface of the first electrode substrate (or the second electrode surface of the second electrode substrate).

(ii) The second electrode (or the first electrode) is formed on the light-emitting layer.

(iii) The first electrode (or the second electrode) is cut at any position along width direction of the long light-emitting sheet to form a non-conductive portion. In this case, considering an end of the electrode in the size of the desired light-emitting sheet, the electrode is cut preferably 2 to 10 mm, more preferably 3 to 8 mm, and still more preferably 4 to 6 mm from the end of the electrode.

(iv) The first electrode and/or the second electrode are cut on two sides along flow direction to form a non-conductive potion. The electrode is cut preferably 2 to 10 mm, more preferably 3 to 8 mm, and still more preferably 4 to 6 mm from the end of electrode.

(v) The obtainable light-emitting sheet is wound-up into a roll.

In the roll-to-roll processes (I) and (II), the above stages may be continuously performed, or a method in which the light-emitting sheet is once wound-up into a roll at each stage and then again unwound may be adopted. Furthermore, a dielectric layer may be formed between each electrode and the light-emitting layer as necessary.

The obtained light-emitting sheet as stated above is suppressed with respect to dielectric breakdown at the time of applying a voltage and does not cause failures such as a short circuit. Therefore, it is excellent in prolonged stability as compared with conventional light-emitting sheets.

EXAMPLES

Next, the present invention will be described in more detail with reference to Examples based on the drawings, but it should be construed that the present invention is not limited at all by these Examples.

It is noted that a weight average molecular weight of a thermoplastic resin in the light-emitting layer used in each of the Examples is a value which is determined by gel permeation chromatography based on monodispersed polystyrene, and calculated in terms of polystyrene standard. In addition, a surface resistivity of each of a first electrode and a second electrode, and a transmittance of a second electrode substrate were measured in the following manners.

[Measurement Method of Surface Resistivity of First Electrode and Second Electrode]

A first electrode substrate and a second electrode substrate were allowed to stand for 24 hours under a condition at 23° C. and a relative humidity of 50% and then measured for a surface resistivity under the same condition by using a surface resistivity meter (a product name: R-127004, manufactured by ADVANTEST CORPORATION).

[Measurement Method of Transmittance of Second Electrode Substrate]

A transmittance of light having a wavelength of 550 nm was measured from the electrode side by using an ultraviolet-visible-near infrared spectrophotometer (a product name: UV-3101PC, manufactured by Shimadzu Corporation).

It is noted that a first substrate, a first electrode, a second substrate, a second electrode, a laminator, and a laser beam machine used in each of the Examples are as follows.

First substrate: Polyethylene terephthalate film (thickness: 50 μm)

First electrode: Aluminum foil (thickness: 12 μm)

A laminate having the first electrode laminated on the first substrate is hereinafter referred to as "first electrode substrate". In each of the Examples, a product name "ALPET (trademark) 12×50" (manufactured by Ajiya Alminum KK) was used as the first electrode substrate. A surface resistivity of the first electrode was found to be 0.5 Ω/□.

Second substrate: polyethylene terephthalate (thickness: 75 μm)

Second electrode: Indium tin oxide (ITO, thickness: 100 nm)

A laminate having the second electrode laminated on the second substrate is hereinafter referred to as "second electrode substrate". In each of the Examples, a product name "MetalForce R-IT (E12)" (manufactured by Nakai Industry Co., Ltd.) was used as the second electrode substrate. A surface resistivity of the second electrode was found to be $10^2$Ω/□, and a transmittance of light having a wavelength of 550 nm from the second electrode substrate was found to be 89%.

Laminator: A trade name "Excelam 355Q" (manufactured by GMP Co., Ltd.)

Laser beam machine: A trade name "$CO_2$ LASER MARKER LP-ADP40" (manufactured by Sunx Limited)

A light-emitting layer used in each of the Examples was produced in the following manners.

(Light Emitting Layer)

A mixture of 100 parts by mass of an acrylic ester copolymer composed of n-butyl acrylate and acrylic acid (n-butyl acrylate/acrylic acid=90/10 (mass ratio), weight average molecular weight: 800,000) as a matrix resin, 300 parts by mass of ZnS/Cu based fluorescent material (a product name: GG25 BlueGreen, manufactured by Osram Sylvania Inc.) as an electroluminescent material, 2 parts by mass of a polyisocyanate based crosslinking agent (a product name: Oribain (trademark) BHS8515, manufactured by Toyo Ink Co., Ltd., solids content: 37.5% by mass), and 500 parts by mass of toluene as a solvent was thoroughly stirred to prepare a coating solution of light-emitting composition.

The obtained coating solution was applied to release surface of a first release film (a product name: SP-PET3811, manufactured by Lintec Corporation; referred to as "first release film" in each of the Examples) with use of a knife coater so as to achieve a dry thickness of 55 μm, and then heated and dried at 100° C. for 2 minutes to form a light-emitting layer; and a second release film (a product name: SP-PET3801, manufactured by Lintec Corporation; referred to as "second release film" in each of the Examples) was laminated onto the surface of the light-emitting layer, thereby obtaining a light-emitting layer having the release film on the both surfaces thereof (referred to as "light-emitting layer-containing sheet" in each of the Examples).

(Dielectric Layer)

A mixture of 100 parts by mass of an acrylic ester copolymer composed of n-butyl acrylate and acrylic acid (n-butyl acrylate/acrylic acid=90/10 (mass ratio), weight average molecular weight: 800,000), 100 parts by mass of titanium oxide (a product name: SZ Color #7030 White, manufactured by Dainichiseika Color & Chemicals Mfg. Co., Ltd.), and 300 parts by mass of toluene as a solvent was thoroughly stirred, applied to a release film (a product name: SP-PET3811, manufactured by Lintec Corporation) so as to achieve a dry thickness of 10 μm and then dried at 100° C. for 2 minutes, thereby forming a dielectric layer on the release film (referred to as "dielectric layer-containing sheet" in each of the Examples).

A dielectric strength test and a short circuit test of the light-emitting sheet obtained in each of the Examples were performed in the following manners.

[Dielectric Strength Test]

With respect to the light-emitting sheet obtained in each of the Examples, a voltage at which dielectric breakdown occurred was measured by using a dielectric strength analyzer (a product name: AC dielectric strength tester 7220, manufactured by KEISOKU GIKEN Co., Ltd.) and increasing an applied voltage in the range of 0 V to 1,000 V for one minute at a current of 10 mA. The larger the voltage at which the dielectric breakdown occurs, the more excellent the dielectric strength properties are.

[Short Circuit Test]

The presence or absence of short circuit at the end of a light-emitting sheet when the light-emitting sheet obtained in each of the Examples was driven at AC 200 V and 2,000 Hz was visually confirmed. It is noted that when a short circuit was generated, black spots were confirmed immediately after driving.

Example 1

Figure 1:
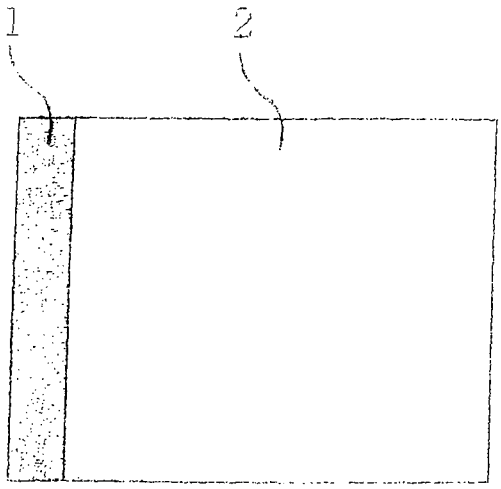
FIG. 1 is a diagram showing a light-emitting sheet 1 comprising a light-emitting layer disposed between a first electrode on a first substrate and a second electrode on a second substrate, as seen from the second electrode surface side.

On a first electrode of a first electrode substrate 1 having a B4 size (364 mm broad by 257 mm long), a light-emitting layer 3 was laminated by using a laminator while removing a second release film of a light-emitting layer-containing sheet having dimension with 257 mm length and 339 mm width. Then, a second electrode substrate 2 was laminated by using a laminator in such a way that a second electrode surface of the second electrode substrate 2 having a B4 size was contacted with the light-emitting layer 3, while removing a first release film of the light-emitting layer 3 laminated, thereby obtaining a light-emitting sheet 1 as shown in FIGS. 1 and 2. It is noted that the shortest distance from a left end of the first electrode substrate to a left end of the light-emitting layer 3 (a width of a portion where the first electrode is exposed), and the shortest distance from a right end of the second electrode substrate to a right end of the light-emitting layer 3 (a width of a portion where the second electrode is exposed) was made 25 mm, respectively.

Figure 3:
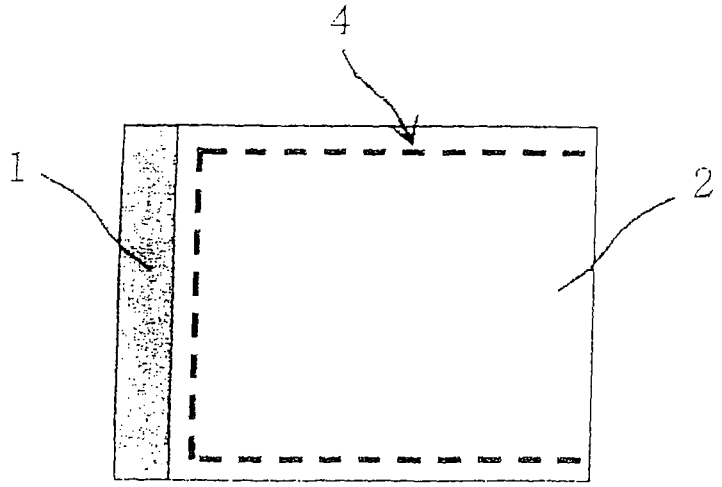
FIG. 3 is a diagram showing a light-emitting sheet (light-emitting sheet 2) obtained by cutting the second electrode of the light-emitting sheet 1 into a U-shape with a laser beam machine.
Figure 6:
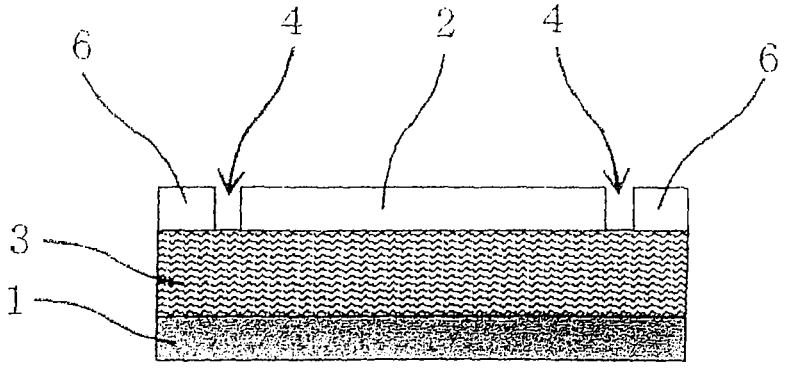
FIG. 6 is a vertical sectional view of the light-emitting sheet 2.

Subsequently, as shown in FIG. 3, the second electrode substrate was cut 5 mm from edges along the edges of the second electrode substrate 2 of the light-emitting sheet 1 (laser cut sections 4 in FIG. 3) into a U-shape by using a laser beam machine under a condition at a laser output of 45 W and a scanning rate of 500 mm/s. It is noted that a width of the laser cut section 4 was 85 μm and a cut depth thereof was 76 μm, and the second electrode was cut to form a non-conductive portion 6 (see FIGS. 5 and 6).

Figure 4:
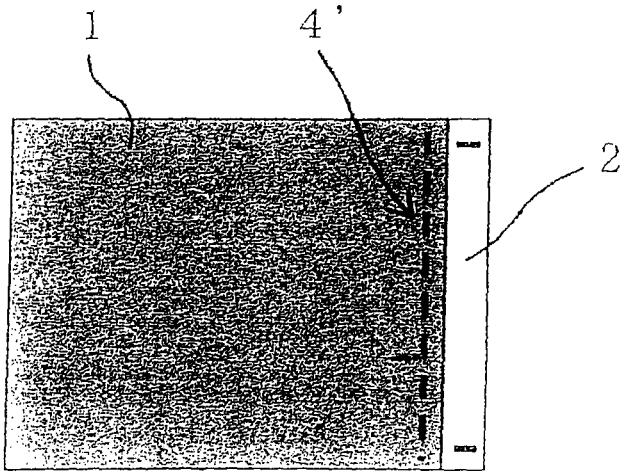
FIG. 4 is a diagram showing a light-emitting sheet (light-emitting sheet 2) obtained by cutting the first electrode of the light-emitting sheet 1 linearly along a vertical direction with a laser beam machine.

Furthermore, as shown in FIG. 4, the first electrode substrate was cut 5 mm from edges along the edges of the first electrode substrate (laser cut sections 4' in FIG. 4) by using a laser beam machine under a condition at a laser output of 75 W and a scanning rate of 300 mm/s. It is noted that a width of the laser cut sections 4' was 85 μm and a cut depth thereof was 94 μm, and the first electrode was cut to form a non-conductive portion 5 (see FIG. 5). The light-emitting sheet comprising the non-conductive portions 5 and 6 (hereinafter referred to as "light-emitting sheet A") was obtained in this way.

A minimum value of a creepage distance between the electrodes (hereinafter referred to as "interelectrode creepage distance"), and the results of dielectric strength test and short circuit test relating to the obtained light-emitting sheet A are shown in Table 2.

Example 2

A light-emitting sheet (hereinafter referred to as "light-emitting sheet B") was obtained in the same manner as in Example 1, except that the first electrode substrate and the second electrode substrate were cut 2 mm from the edges of the electrode substrates, and the creepage distance was shortened as shown in FIG. 2.

The interelectrode creepage distance and the results of dielectric strength test and short circuit test relating to the obtained light-emitting sheet B are shown in Table 2.

Example 3

A light-emitting sheet C was obtained in the same manner as in Example 1, except that a dielectric layer having a 10 μm-thick was formed between the first electrode and the light-emitting layer 3. That is, a dielectric layer containing-sheet was laminated on the first electrode surface of the first electrode substrate, the release film was removed to form a laminate with the dielectric layer having a 10 μm-thick, and then the light-emitting layer 3 and the second electrode substrate were laminated on the dielectric layer in a similar way of Example 1, thereby obtaining the light-emitting sheet (hereinafter, referred to as "the light-emitting sheet C).

The interelectrode creepage distance and the results of dielectric strength test and short circuit test relating to the obtained light-emitting sheet C are shown in Table 2.

Example 4

A light-emitting sheet (hereinafter referred to as "light-emitting sheet D") was obtained in the same manner as in Example 1, except that the first electrode substrate 1 was cut under a condition at laser output of 38 W and a scanning rate of 500 mm/s. A width of a laser cut section 4' of the first electrode substrate 1 was 83 μm and a cut depth thereof was 71 μm, and the first electrode was cut to form a non-conductive portion 5.

The interelectrode creepage distance and the results of dielectric strength test and short circuit test relating to the obtained light-emitting sheet D are shown in Table 2.

Comparative Example 1

A light-emitting sheet (hereinafter referred to as "light-emitting sheet E") was obtained in the same manner as in Example 1, except that a non-conductive portion was not formed at all on the first electrode and the second electrode.

The interelectrode creepage distance and the results of dielectric strength test and short circuit test relating to the obtained light-emitting sheet E are shown in Table 2.

Comparative Example 2

A light-emitting sheet (hereinafter referred to as "light-emitting sheet F") was obtained in the same manner as in Example 1, except that a non-conductive portion was formed only on the second electrode, and a non-conductive portion was not formed on the first electrode.

The interelectrode creepage distance and the results of dielectric strength test and short circuit test relating to the obtained light-emitting sheet F are shown in Table 2.

TABLE 2

| | | Interelectrode | Test results | |
|---|---|---|---|---|
| | Light-emitting sheet | creepage distance [1] (mm) | dielectric strength (V) | Presence or absence of short circuit |
| Example 1 | A | 5.055 | 1,000 or more | Absence |
| Example 2 | B | 2.055 | 1,000 or more | Absence |
| Example 3 | C | 5.065 | 1,000 or more | Absence |
| Example 4 | D | 5.055 | 1,000 or more | Absence |
| Comparative Example 1 | E | 0.055 | 478 | Presence [2] |
| Comparative Example 2 | F | 0.055 | 456 | Presence [2] |

[1] A minimum value of the creepage distance of from the edge of the conductive section of the first electrode to the edge of the conductive section of the second electrode
[2] Black spots were confirmed immediately after applying a voltage.

From Table 2, the light-emitting sheet in which according to the invention, the first electrode and/or the second electrode disposed on or under the periphery of the light-emitting layer were cut to form the non-conductive portion being electrically disconnected was high in the dielectric strength property and free from the short circuit at driving (see Examples 1 to 4).

On the other hand, in the light-emitting sheet in which the first electrode and/or the second electrode disposed on and under the periphery of the light-emitting layer were not cut at all (see Comparative Example 1) and the light-emitting sheet in which the first electrode and/or the second electrode disposed on and under the periphery of the light-emitting layer was not partially cut, and as seen from a vertical direction to the plane of the light-emitting sheet, the non-conductive portion formed from the first electrode and the non-conductive portion formed from the second electrode did not apparently surround the light-emitting layer (see Comparative Example 2), not only the dielectric strength property was low, but the short circuit was generated at driving.

INDUSTRIAL APPLICABILITY

The light-emitting sheet of the present invention is useful in fields where weather resistance, heat resistance, long-term stability, or the like is required, for example, backlight for advertising media disposed on windows of commercial buildings and automobiles, decorating media, security sheets, and the like.

| Explanations of Letters or Numerals | |
|---|---|
| 1: | First electrode substrate |
| 2: | Second electrode substrate |
| 3: | Light-emitting layer |
| 4, 4': | Laser cut section |
| 5: | Non-conductive portion of first electrode |
| 6: | Non-conductive portion of second electrode |
| 7: | Side surface site of light-emitting layer (periphery of light-emitting layer) |

The invention claimed is:

1. A light-emitting sheet, comprising:

a first electrode;

a second electrode; and a light-emitting layer disposed between the first and the second electrodes, wherein:

at least one electrode selected from the group consisting of the first electrode and the second electrode is disposed on and under a periphery of the light-emitting layer is divided into a non-conductive portion, which is electrically disconnected from a circuit that applies a voltage to the light-emitting sheet, and a conductive portion;

the non-conductive portion and the conductive portion of the at least one electrode are separated by a cut section that is obtained by cutting the at least one electrode such that the electrode is cut without completely cutting the light emitting layer;

the cut section is located inside the end of the light-emitting layer;

a creepage distance between an edge of the conductive portion of the first electrode and an edge of the conductive portion of the second electrode is 2 mm or more; and when viewing the light emitting sheet from a vertical direction to a plane of the light-emitting sheet, the non-conductive portion of the first electrode or the non-conductive portion of the second electrode surrounds the light-emitting layer, or the non-conductive portion of the first electrode and the non-conductive portion of the second electrode are apparently connected to each other and surround the light-emitting layer.

2. The light-emitting sheet of claim 1, wherein the cutting section is obtained by cutting the at least one electrode with a laser.

3. The light-emitting sheet of claim 1, wherein the creepage distance between a conductive portion of the first electrode and a conductive portion of the second electrode, which are electrically connected to each other, is 2.5 mm or more.

4. The light-emitting sheet of claim 1, further comprising:

a dielectric layer between the first electrode and the light-emitting layer.

5. The light-emitting sheet of claim 1, further comprising:

a dielectric layer between the second electrode and the light-emitting layer.

6. The light-emitting sheet of claim 1, wherein the first electrode comprises a non-conductive portion, which is electrically disconnected from a circuit, and when viewing the light emitting sheet from a vertical direction to a plane of the light-emitting sheet, the non-conductive portion of the first electrode surrounds the light-emitting layer.

7. The light-emitting sheet of claim 6, wherein the non-conductive portion of the first electrode is obtained by cutting the first electrode with a laser.

8. The light-emitting sheet of claim 7, wherein the creepage distance between a conductive portion of the first electrode and a conductive portion of the second electrode, which are electrically connected to each other, is 2.5 mm or more.

9. The light-emitting sheet of claim 8, further comprising:

a dielectric layer between the first electrode and the light-emitting layer.

10. The light-emitting sheet of claim 8, further comprising:

a dielectric layer between the second electrode and the light-emitting layer.

11. The light-emitting sheet of claim 1, wherein the second electrode comprises a non-conductive portion, which is electrically disconnected from a circuit, and when viewing the light emitting sheet from a vertical direction to a plane of the light-emitting sheet, the non-conductive portion of the second electrode surrounds the light-emitting layer.

12. The light-emitting sheet of claim 11, wherein the non-conductive portion of the second electrode is obtained cutting the second electrode with a laser.

13. The light-emitting sheet of claim 12, wherein the creepage distance between a conductive portion of the first electrode and a conductive portion of the second electrode, which are electrically connected to each other, is 2.5 mm or more.

14. The light-emitting sheet of claim 13, further comprising:

a dielectric layer between the first electrode and the light-emitting layer.

15. The light-emitting sheet of claim 13, further comprising:

a dielectric layer between the second electrode and the light-emitting layer.

16. The light-emitting sheet of claim 1, wherein the first and the second electrode each comprise a non-conductive portion, which are electrically disconnected from a circuit, and when viewing the light emitting sheet from a vertical direction to a plane of the light-emitting sheet, the non-conductive portion of the first and second electrodes are apparently connected to each other and surround the light-emitting layer.

17. The light-emitting sheet of claim 16, wherein the non-conductive portion of the first electrode and the non-conductive portion of the second electrode are obtained by cutting the first and second electrode with a laser, respectively.

18. The light-emitting sheet of claim 17, wherein the creepage distance between a conductive portion of the first electrode and a conductive portion of the second electrode, which are electrically connected to each other, is 2.5 mm or more.

19. The light-emitting sheet of claim 18, further comprising:

a dielectric layer between the first electrode and the light-emitting layer.

20. The light-emitting sheet of claim 18, further comprising:

a dielectric layer between the second electrode and the light-emitting layer.

* * * * *